US008704161B2

(12) United States Patent
Kawana

(10) Patent No.: US 8,704,161 B2
(45) Date of Patent: Apr. 22, 2014

(54) QUADRUPOLE MASS SPECTROMETER INCLUDING VOLTAGE VARIABLE DC AND AMPLITUDE VARIABLE AC

(75) Inventor: Shuichi Kawana, Kyoto (JP)

(73) Assignee: Shimadzu Corporation, Kyoto (JP)

( * ) Notice: Subject to any disclaimer, the term of this patent is extended or adjusted under 35 U.S.C. 154(b) by 1082 days.

(21) Appl. No.: 12/564,606

(22) Filed: Sep. 22, 2009

(65) Prior Publication Data

US 2010/0084552 A1 Apr. 8, 2010

(30) Foreign Application Priority Data

Oct. 6, 2008 (JP) ..... 2008-259155

(51) Int. Cl.
*H01J 49/44* (2006.01)
*H01J 49/34* (2006.01)

(52) U.S. Cl.
USPC ..... 250/281; 250/292

(58) Field of Classification Search
USPC ..... 250/281, 282, 292
See application file for complete search history.

(56) References Cited

U.S. PATENT DOCUMENTS

| | | | | |
|---|---|---|---|---|
| 3,648,046 | A * | 3/1972 | Denison et al. | 250/281 |
| 3,735,287 | A * | 5/1973 | Lowe | 250/292 |
| 5,291,017 | A * | 3/1994 | Wang et al. | 250/292 |
| 6,153,880 | A * | 11/2000 | Russ et al. | 250/292 |
| 6,573,496 | B2 | 6/2003 | Harada | |
| 7,034,292 | B1 * | 4/2006 | Whitehouse et al. | 250/289 |
| 7,312,444 | B1 * | 12/2007 | Willougbhy et al. | 250/293 |
| 7,498,571 | B2 * | 3/2009 | Makarov et al. | 250/292 |
| 8,084,733 | B2 * | 12/2011 | Russ et al. | 250/282 |
| 8,227,751 | B2 * | 7/2012 | Green | 250/292 |
| 2004/0135080 | A1 * | 7/2004 | Ouyang et al. | 250/292 |
| 2005/0274887 | A1 * | 12/2005 | Weiss et al. | 250/292 |
| 2006/0016985 | A1 * | 1/2006 | Roushall et al. | 250/292 |
| 2008/0078926 | A1 | 4/2008 | Russ, IV et al. | |
| 2010/0084552 | A1 | 4/2010 | Kawana | |
| 2011/0101221 | A1 | 5/2011 | Mukaibatake et al. | |

FOREIGN PATENT DOCUMENTS

| | | |
|---|---|---|
| JP | 04-106858 | 4/1992 |
| JP | 04-289652 A | 10/1992 |
| JP | 08-129001 A | 5/1996 |
| JP | 2000-195464 | 7/2000 |
| JP | 2000-195464 A | 7/2000 |
| JP | 2001-202918 | 7/2001 |

OTHER PUBLICATIONS

Japanese Final Office Action mailed Mar. 27, 2012 issued in JP Patent Application No. 2008-259155.

* cited by examiner

*Primary Examiner* — Robert Kim
*Assistant Examiner* — Brooke Purinton
(74) *Attorney, Agent, or Firm* — Sughrue Mion, PLLC

(57) ABSTRACT

Disclosed is a quadrupole mass spectrometer, which is capable of, during an SIM measurement, maximally reducing a settling time-period necessary for an operation of changing an input voltage to a quadrupole mass filter in a staircase pattern, and preventing unwanted ions from excessively entering a detector during a course of changing between a plurality of mass values. Under a condition that a response speed of a DC voltage U to be applied to quadrupole electrodes is less than that of an amplitude of a high-frequency voltage V, a control section 10 is operable to rearrange the mass values in descending order of mass value, and an optimal settling-time calculation sub-section 101 is operable to determine a settling time-period for each of the mass values, based on a mass-value difference and a post-change mass value.

12 Claims, 6 Drawing Sheets

Example where voltage U has response speed less than that of voltage V

Example where voltage U has response speed less than that of voltage V

Example where voltage V has response speed less than that of voltage U

Example of settling-time setting table

| | | Mass-value difference ΔM | | |
|---|---|---|---|---|
| | | 0 - 99 | 100 - 299 | 300 - |
| Post-change mass value | 2 - 49 | 3 (ms) | 4 | 5 |
| | 50 - 99 | 2 | 3 | 4 |
| | 100 - 1090 | 1 | 2 | 4 |

QUADRUPOLE MASS SPECTROMETER INCLUDING VOLTAGE VARIABLE DC AND AMPLITUDE VARIABLE AC

BACKGROUND OF THE INVENTION

1. Field of the Invention

The present invention relates to a quadrupole mass spectrometer using a quadrupole mass filter as a mass analyzer operable to separate ions according to mass values (e.g., m/z (mass-to-charge ratio) values).

2. Description of the Background Art

A quadrupole mass spectrometer is designed to apply a voltage (input voltage) formed by superimposing a high-frequency (e.g., radio-frequency) voltage on a direct-current (DC) voltage, to four rod electrodes constituting a quadrupole mass filter, to allow only an ion having a mass corresponding to a value of the input voltage to selectively pass through the quadrupole mass filter and reach an ion detector. Recently, a gas chromatograph/mass spectrometer (GC/MS) and a liquid chromatograph/mass spectrometer (LC/MS) produced by combining the quadrupole mass spectrometer with respective ones of a gas chromatograph and a liquid chromatograph are widely used in various fields.

A scan measurement and a selected ion monitoring (SIM) measurement are well known as a measurement mode of the quadrupole mass spectrometer (see, for example, the following Patent Document 1). The scan measurement is configured to repetitively perform a control/processing of scanning (continuously changing) a voltage to be applied to the rod electrodes of the quadrupole mass filter, so as to scan (continuously change) a mass value for an ion to be allowed to reach to the ion detector, over a given mass range. The scan measurement shows excellent ability, particularly, in qualitative analysis for a sample containing a substance whose mass is unknown. The SIM measurement is configured to repetitively perform mass analysis for ions having ones of a plurality of mass values pre-set by a user, while sequentially changing between the plurality of mass values. The SIM measurement shows excellent ability, particularly, in quantitative analysis for a substance whose mass is known.

In the SIM measurement, when a plurality of mass values are designated as a measurement parameter by an operator, the conventional quadrupole mass spectrometer is operable to arrange the mass values in an order designated by the operator. Thus, if the operator designates the mass values in ascending order (or descending order) of mass value, an input voltage in one cycle of the SIM measurement will be changed in a staircase pattern, as shown in FIG. 9A. Otherwise, the input voltage in one cycle of the SIM measurement will be changed up and down, as shown in FIG. 9B. In such cases, the following problems occur.

During a course of changing from a certain one to a next one of the plurality of mass values, the voltage to be applied to the rod electrodes of the quadrupole mass filter is changed in a stepped manner. Such a voltage change inevitably involves the occurrence of a certain level of overshoot (or undershoot) and ringing. Thus, it is necessary to provide a waiting time-period (i.e., a settling time-period) just after the voltage change to continue until a post-change voltage becomes moderately stable, and, after an elapse of the settling time-period, perform a substantial ion detection operation for the mass value corresponding to a value of the post-change voltage. In this case, during the settling time-period, any mass analysis for components of a sample introduced from a GC or LC into an ion source is not performed. Thus, as the settling time-period becomes longer, a time interval between measurements for the same mass value in adjacent cycles becomes larger, to cause deterioration in time resolution. Although a duration of one cycle may be shortened to enhance the time resolution, it causes a reduction in ion detection time-period for each of the mass values, which leads to deterioration in sensitivity and SN ratio. In the case where the mass values are randomly set as shown in FIG. 9B, an amount of voltage change becomes larger on average, and thereby the settling time-period undesirably becomes longer.

Further, if the quadrupole mass filter is set to allow a large number of ions to pass therethrough during a transitional period where the input voltage is changed from a first value for allowing only an ion having a certain one of the mass values to selectively pass through the quadrupole mass filter, to a second value for allowing only an ion having a next one of the mass values to selectively pass through the quadrupole mass filter, an excessive amount of ions is likely to enter the ion detector to cause a risk of shortening a usable life of the ion detector. However, the conventional quadrupole mass spectrometer is not designed while taking into account the phenomenon that unwanted ions pass through the quadrupole mass filter during the change between the mass values. Thus, depending on a setting order of the mass values and/or characteristics of the quadrupole mass spectrometer itself, an excessive amount of ions is likely to reach the ion detector.

The above problems occur not only in the SIM measurement, but also in an SIM/scan alternate measurement mode configured to alternately perform the SIM measurement for a plurality of mass values and the scan measurement over a given mass range, in one cycle, and repeat the cycle (see, for example, the following Patent Document 2).

[Patent Document 1] JP 08-129001A

[Patent Document 2] JP 2000-195464A

SUMMARY OF THE INVENTION

In view of the above problems, it is an object of the present invention to provide a quadrupole mass spectrometer capable of, during an SIM measurement or an SIM/scan alternate measurement, maximally reducing a settling time-period having no substantial contribution to mass analysis. This shortens a duration of a repetitive cycle to enhance time resolution, and avoids a phenomenon that unwanted ions excessively reach an ion detector during a change between a plurality of mass values.

In order to achieve the above object, according to a first aspect of the present invention, there is provided a quadrupole mass spectrometer equipped with a quadrupole mass filter for allowing an ion having a specific mass to selectively pass therethrough and a detector for detecting the ion passing through the quadrupole mass filter, and designed to perform a selected ion monitoring (SIM) or multiple reaction monitoring (MRM) measurement configured to repeat a cycle of operation to sequentially change between a plurality of pre-set mass values for respective ions to be allowed to pass through the quadrupole mass filter. The quadrupole mass spectrometer comprises (a) quadrupole driving means including a voltage-variable DC voltage source and an amplitude-variable AC voltage source, wherein the quadrupole driving means is operable to apply a voltage formed by adding a DC voltage from the DC voltage source and an AC voltage from the AC voltage source, to four electrodes constituting the quadrupole mass filter, with a characteristic that, during an operation of causing a discrete change in the mass value for an ion be allowed to pass through the quadrupole mass filter, a response speed in terms of voltage change based on the DC voltage source is less than a response speed in terms of amplitude change based on the AC voltage source, and (b) measurement sequence creation means operable to rearrange a plurality of mass values designated for performing the SIM or MRM measurement, in descending order of mass value, to create one cycle of an SIM or MRM measurement sequence.

In order to achieve the above object, according to a second aspect of the present invention, there is provided a quadrupole mass spectrometer equipped with a quadrupole mass filter for allowing an ion having a specific mass to selectively pass therethrough and a detector for detecting the ion passing through the quadrupole mass filter, and designed to perform a selected ion monitoring (SIM) or multiple reaction monitoring (MRM) measurement configured to repeat a cycle of operation to sequentially change between a plurality of pre-set mass values for respective ions to be allowed to pass through the quadrupole mass filter. The quadrupole mass spectrometer comprises (a) quadrupole driving means including a voltage-variable DC voltage source and an amplitude-variable AC voltage source, wherein the quadrupole driving means is operable to apply a voltage formed by adding a DC voltage from the DC voltage source and an AC voltage from the AC voltage source, to four electrodes constituting the quadrupole mass filter, with a characteristic that, during an operation of causing a discrete change in the mass value for an ion to be allowed to pass through the quadrupole mass filter, a response speed in terms of voltage change based on the DC voltage source is greater than a response speed in terms of amplitude change based on the AC voltage source, and (b) measurement sequence creation means operable to rearrange a plurality of mass values designated for performing the SIM or MRM measurement, in ascending order of mass value, to create one cycle of an SIM or MRM measurement sequence.

In the quadrupole mass spectrometer according to the first aspect of the present invention, for example, in the SIM measurement, when a plurality of mass values for use in the SIM measurement are input and designated by a user or operator, the measurement sequence creation means is operable to rearrange the mass values in descending order of mass value, irrespective of an order of inputting by the user, to create one cycle of the SIM measurement sequence. In the quadrupole mass spectrometer according to the second aspect of the present invention, the measurement sequence creation means is operable to rearrange the mass values in ascending order of mass value, irrespective of an order of inputting by the user, to create one cycle of the SIM measurement sequence. In this manner, the mass value are rearranged, so that, in at least one cycle of the SIM measurement, a difference between a certain one and a next one of the mass values can be minimized on average. Thus, during the change between the mass values, a change in voltage (input voltage) to be applied from the quadrupole driving means to the electrodes of the quadrupole mass filter becomes relatively reduced, so that a settling time-period required for a post-change voltage to become stable can be shortened.

In the quadrupole mass spectrometer according to the first aspect of the present invention, the quadrupole driving means has the characteristic that the response speed in terms of voltage change based on the DC voltage source is less than the response speed in terms of amplitude change based on the AC voltage source. Thus, when the change between the mass values is performed in a descending direction, i.e., the input voltage is changed from a relatively high value to a relative low value, a line indicative of a change in the input voltage becomes highly likely to deviate from a generally triangular stable region in a stability diagram which has a vertical axis representing a DC voltage value and a horizontal axis representing a amplitude value of a radio-frequency voltage. The deviation from the stable region means that ions just before passing through the quadrupole mass filter diverge on the way and cannot pass through the quadrupole mass filter. This makes it possible to keep unwanted ions from passing through the quadrupole mass filter and reaching the detector during the change between the mass values.

Conversely, in the quadrupole mass spectrometer according to the second aspect of the present invention, the quadrupole driving means has the characteristic that the response speed in terms of amplitude change based on the AC voltage source is less than the response speed in terms of voltage change based on the DC voltage source. Thus, when the change between the mass values is performed in an ascending direction, i.e., the input voltage is changed from a relatively low value to a relative high value, a line indicative of a change in the input voltage becomes highly likely to deviate from the stable region in the stability diagram. This also makes it possible to keep unwanted ions from passing through the quadrupole mass filter and reaching the detector during the change between the mass values.

In the quadrupole mass spectrometer according to each of the first and second aspects of the present invention, during transition from the last one of the mass values in a certain cycle to the first one of the mass values in a next cycle, an ascending/descending direction of a change in mass value during the certain cycle is reversed, so that a line indicative of a change in the input voltage becomes highly likely to pass through the stable region in the stability diagram.

If there is a problem that unwanted ions reach the detector during such transition, it is preferable that the quadrupole mass spectrometer according to each of the first and second aspects of the present invention further comprises: either one of a pre-filter disposed upstream of the quadrupole mass filter, and an ion optical system for introducing an ion into the quadrupole mass filter or the pre-filter; and input voltage control means operable to apply a DC voltage having a polarity opposite to that of a target ion, to the pre-filter or the ion optical system, in such a manner as to block the ion from passing therethrough, during at least a part of a time-period between completion of a certain cycle of the SIM or MRM measurement and start of a next cycle of the SIM or MRM measurement.

In the SIM or MRM measurement, the above feature makes it possible to keep unwanted ions from reaching the detector, not only during the operation of sequentially changing between the mass values in one cycle, but also during the transitional period between completion of a certain cycle and start of a next cycle, where a large change in mass value occurs.

In order to achieve the above object, according to a third aspect of the present invention, there is provided a quadrupole mass spectrometer equipped with a quadrupole mass filter for allowing an ion having a specific mass to selectively pass therethrough and a detector for detecting the ion passing through the quadrupole mass filter, and designed to perform a selected ion monitoring (SIM)/scan alternate measurement which is configured to alternately perform an SIM measurement configured to sequentially change between a plurality of pre-set mass values for respective ions to be allowed to pass through the quadrupole mass filter, and a scan measurement configured to continuously change a mass value for an ion to be allowed to pass through the quadrupole mass filter, over a given mass range. The quadrupole mass spectrometer comprises (a) quadrupole driving means including a voltage-variable DC voltage source and an amplitude-variable AC voltage source, wherein the quadrupole driving means is operable to apply a voltage formed by adding a DC voltage from the DC voltage source and an AC voltage from the AC voltage source, to four electrodes constituting the quadrupole mass filter, with a characteristic that, during an operation of causing a discrete change in the mass value for an ion to be allowed to pass through the quadrupole mass filter, a response speed in terms of voltage change based on the DC voltage source is less than a response speed in terms of amplitude change based on the AC voltage source, and (b) measurement sequence creation means operable to rearrange a plurality of mass values designated for performing the SIM measurement, in descending order of mass value, and set a continuous change in mass value in an ascending direction over a mass range designated for performing the scan measurement, to create an SIM/scan alternate measurement sequence.

In order to achieve the above object, according to a fourth aspect of the present invention, there is provided a quadrupole mass spectrometer equipped with a quadrupole mass filter for allowing an ion having a specific mass to selectively pass therethrough and a detector for detecting the ion passing through the quadrupole mass filter, and designed to perform a selected ion monitoring (SIM)/scan alternate measurement which is configured to alternately perform an SIM measurement configured to sequentially change between a plurality of pre-set mass values for respective ions to be allowed to pass through the quadrupole mass filter, and a scan measurement configured to continuously change a mass value for an ion to be allowed to pass through the quadrupole mass filter, over a given mass range. The quadrupole mass spectrometer comprises (a) quadrupole driving means including a voltage-variable DC voltage source and an amplitude-variable AC voltage source, wherein the quadrupole driving means is operable to apply a voltage formed by adding a DC voltage from the DC voltage source and an AC voltage from the AC voltage source, to four electrodes constituting the quadrupole mass filter, with a characteristic that, during an operation of causing a discrete change in the mass value for an ion to be allowed to pass through the quadrupole mass filter, a response speed in terms of voltage change based on the DC voltage source is greater than a response speed in terms of amplitude change based on the AC voltage source, and (b) sequence creation means operable to rearrange a plurality of mass values designated for performing the SIM measurement, in ascending order of mass value, and set a continuous change in mass value in a descending direction over a mass range designated for performing the scan measurement, to create an SIM/scan alternate measurement sequence.

In the quadrupole mass spectrometer according to each of the third and fourth aspects of the present invention, the mass values for the SIM measurement are rearranged in descending or ascending order of mass value, in the same manner as in the quadrupole mass spectrometer according to each of the first and second aspects of the present invention. This makes it possible to shorten a settling time-period. In addition, the quadrupole driving means has the characteristic that the response speed in terms of voltage change based on the DC voltage source is less or greater than the response speed in terms of amplitude change based on the AC voltage source. This makes it possible to prevent unwanted ions from passing through the quadrupole mass filter during the change between the mass values, so as to suppress damage of the detector due to excessive entry of ions.

In the quadrupole mass spectrometer according to each of the third and fourth aspects of the present invention, if there is a problem that unwanted ions reach the detector during transition from the scan measurement to the SIM measurement or from the SIM measurement to the scan measurement, it is preferable that the quadrupole mass spectrometer further comprises: either one of a pre-filter disposed upstream of the quadrupole mass filter, and an ion optical system for introducing an ion into the quadrupole mass filter or the pre-filter; and input voltage control means operable, when the mass value is changed in a direction causing an increase thereof during a time-period between completion of the scan measurement and start of the subsequent SIM measurement or between completion of the SIM measurement and start of the subsequent scan measurement, to apply a DC voltage having a polarity opposite to that of a target ion, to the pre-filter or the ion optical system, in such a manner as to block the ion from passing therethrough, during at least a part of the time-period.

As above, in the quadrupole mass spectrometer according to each of the first to fourth aspects of the present invention, during the operation of changing between the mass values, an input voltage to be applied to the electrodes of the quadrupole mass filter is quickly stabilized, so that an excessive and unnecessary waiting time-period can be shortened. Thus, for example, in the SIM or MRM measurement, even if a measurement time-period for each of the mass values is set at a constant value, a duration of a repetitive cycle for the plurality of mass values can be shortened by reducing a dead time, to enhance time resolution. In case where the duration of the repetitive cycle is not shortened, a time-period substantially assignable to an ion detection in a duration of one cycle becomes longer, so that sensitivity and SN ratio can be enhanced.

Further, the quadrupole mass spectrometer according to each of the first to fourth aspects of the present invention can keep unwanted ions having masses other than the mass values from passing through the quadrupole mass filter and entering the detector during the operation of changing between the mass values. This makes it possible to reduce unwanted damage of the detector so as to extend a usable life of the detector.

DESCRIPTION OF THE EXEMPLARY EMBODIMENTS

Figure 1:
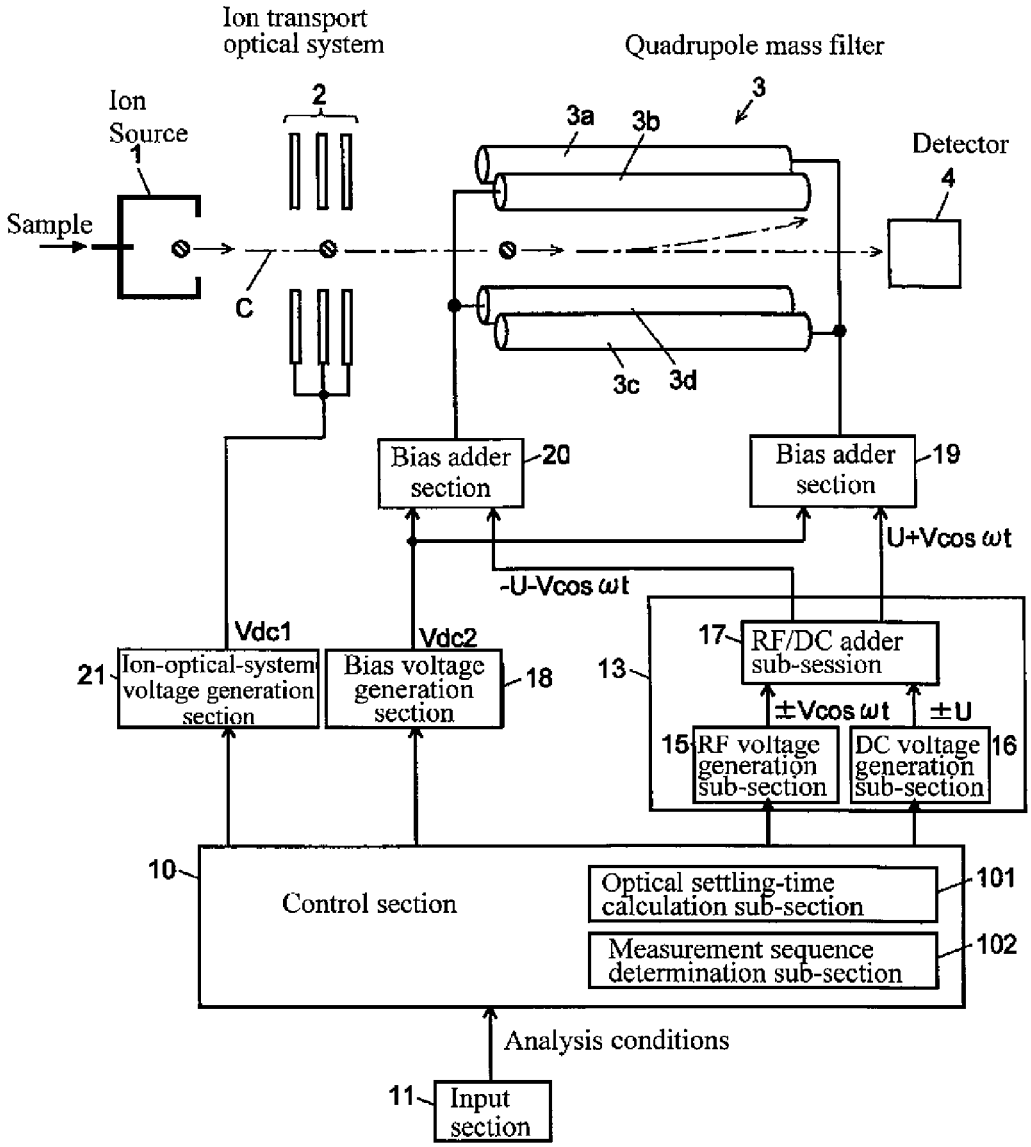
FIG. 1 is a fragmentary block diagram showing a quadrupole mass spectrometer according to one exemplary embodiment of the present invention.

With reference to the accompanying drawings, the present invention will now be described based on one exemplary embodiment thereof. FIG. 1 is a fragmentary block diagram showing a quadrupole mass spectrometer according to this embodiment.

The quadrupole mass spectrometer according to this exemplary embodiment comprises an ion source 1, an ion transport optical system 2, a quadrupole mass filter 3 and an ion detector 4, which are installed inside a vacuum chamber (not shown). The quadrupole mass filter 3 includes four rod electrodes 3*a*, 3*b*, 3*c*, 3*d* each disposed to be inscribed in a circular cylindrical plane having an axis defined by an ion optical axis C and a given radius with a center on the axis. The four rod electrodes 3*a*, 3*b*, 3*c*, 3*d* are arranged to form two pairs each disposed in opposed relation across the ion optical axis C (i.e., the pair of rod electrodes 3*a*, 3*c* and the pair of rod electrodes 3*b*, 3*d*), and each of the pair of rod electrodes 3*a*, 3*c* and the pair of rod electrodes 3*b*, 3*d* are electrically connected together. The quadrupole mass spectrometer also comprises an ion-selecting voltage generation section 13, a bias voltage generation section 18 and two bias adder sections 19, 20, which collectively serve as quadrupole driving means operable to apply a voltage to the four rod electrodes 3*a*, 3*b*, 3*c*, 3*d*. The ion-selecting voltage generation section 13 includes a direct-current (DC) voltage generation sub-section 16, a radio-frequency (RF) voltage generation sub-section 15 and a radio-frequency/direct-current (RF/DC) adder sub-section 17.

Although not illustrated, a gas chromatograph (GC) is connected to an upstream side of the quadrupole mass spectrometer, and a gaseous sample having components separated through a column of the GC is introduced into the ion source 1. Alternatively, a liquid chromatograph (LC) may be connected to the upstream side of the quadrupole mass spectrometer. In this case, an atmospheric pressure ion source, such as an electrospray ion source, may be used as the ion source 1, and a multistage differential evacuation system may be employed to maintain an internal atmosphere of each of the quadrupole mass filter 3 and the ion detector 4 in a high-vacuum state, while maintaining an internal atmosphere of the ion source 1 in an approximately atmospheric state.

Further, the quadrupole mass spectrometer comprises an ion-optical-system voltage generation section 21 and a control section 10. The ion-optical-system voltage generation section 21 is operable to apply a DC voltage Vdc1 to the ion transport optical system 2 on an upstream side of the quadrupole mass filter 3 and, as needed, apply a DC voltage having a polarity opposite to that of an ion, to the ion transport optical system 2, to attract the ion, as described later. The control section 10 serves as a means to control respective operations of the ion-optical-system voltage generation section 21, the ion-selecting voltage generation section 13, the bias voltage generation section 18 and other sections and sub-sections, and functionally includes an optimal settling-time calculation sub-section 101 and a measurement-sequence determination sub-section 102. The control section 10 is connected with an input section 11 for allowing a user or operator to perform an input operation therethrough. Functions of the control section 10 and a data processing section (not shown) are achieved primarily by a computer comprising a CPU and a memory.

In the ion-selecting voltage generation section 13, the DC voltage generation sub-section 16 is operable, under control of the control section 10, to generate two DC voltages ±U which are different in polarity. The RF voltage generation sub-section 15 is operable, under control of the control section 10, to generate two RF voltages $\pm V\cdot\cos\omega t$ which are out of phase by 180°. The RF/DC adder sub-section 17 is operable to add the DC voltages ±U and the RF voltages $\pm V\cdot\cos\omega t$ together to generate dual voltages $U+V\cdot\cos\omega t$ and $-(U+V\cdot\cos\omega t)$. The dual voltages serve as ion-selecting voltages which determine a mass (e.g., m/z ratio) value for an ion to be allowed to pass through the quadrupole mass filter 3.

The bias voltage generation section 18 is operable to generate a DC bias voltage Vdc2 to be commonly applied to respective ones of the rod electrodes 3*a* to 3*d*, in such a manner that a voltage difference between the DC bias voltage Vdc2 and the DC voltage Vdc1 to be applied to the ion transport optical system 2 is set at a value suitable for forming a DC electric field on an immediate upstream side of the quadrupole mass filter 3 to allow ions to be efficiently introduced into a space of the quadrupole mass filter 3 in a longitudinal direction thereof. The bias adder section 19 is operable to add the ion-selecting voltage $U+V\cdot\cos\omega t$ and the DC bias voltage Vdc2 to form a voltage Vdc2$+U+V\cdot\cos\omega t$, and apply the formed voltage to the rod electrodes 3*a*, 3*c*, and the bias adder section 20 is operable to add the ion-selecting voltage$-(U+V\cdot\cos\omega t)$ and the DC bias voltage Vdc2 to form a voltage Vdc2$-(U+V\cdot\cos\omega t)$, and apply the formed voltage to the rod electrodes 3*b*, 3*d*. Each of the DC bias voltages Vdc1, Vdc2 may be set at an optimal value through an automatic tuning to be performed using a standard sample, etc.

Generally, in the ion-selecting voltage generation section 13, the DC voltage generation sub-section 16 and the RF voltage generation sub-section 15 are different from each other in a time-period required for a voltage to become stable. This difference may arise from a difference in circuit configuration caused by using an LC resonant circuit, etc., or may arise from a difference in restriction on control, such as delay of a voltage setting command to be given from the control section 10. The following description will be made based on an example where a response speed in terms of voltage change based on the DC voltage generation sub-section 16 is less than a response speed in terms of amplitude change based on the RF voltage generation sub-section 15, i.e., in the ion-selecting voltage $\pm(U+V\cdot\cos\omega t)$, the voltage U has a response speed less than that of the voltage V.

In the SIM measurement mode, in advance to issuing an instruction on start of the SIM measurement, a user uses the input section 11 to input and designate, as analysis conditions, a plurality of mass values in one cycle, and an interval span Ta which is a duration of one cycle. In this operation, an order of mass values to be designated is not particularly limited, but may be arbitrary. Further, the number of mass values to be used in one cycle is fundamentally arbitrary (it is understood that an allowable upper limit of the number may be set). The control section 10 is operable to rearrange the designated mass values in descending order of mass value. Specifically, given that five mass values M11, M12, M13, M14, M15 (wherein M11<M12<M13<M14<M15) are designated, the control section 10 is operable to rearrange the designated mass values in the following order: M15, M14, M13, M12, M11.

Figures 6, 7:
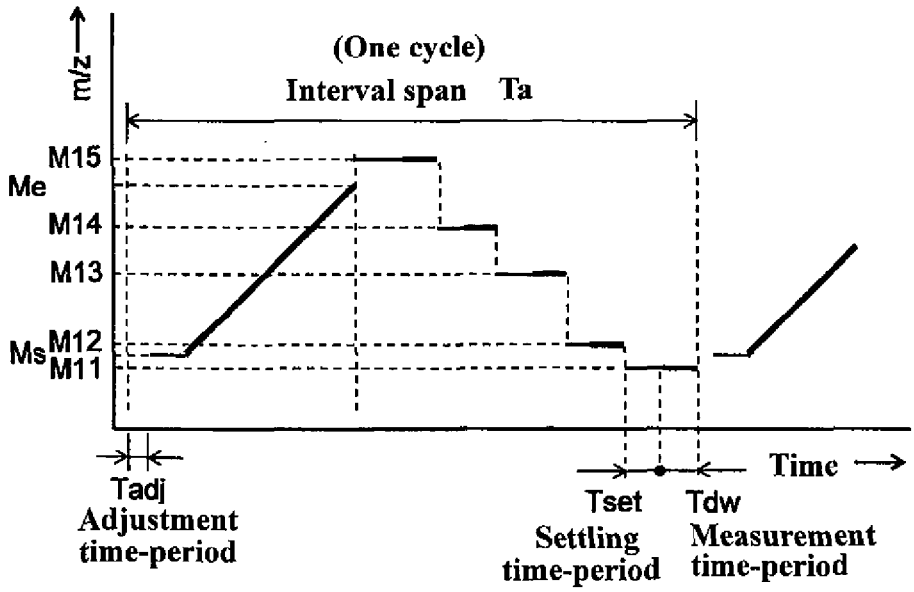
FIG. 6 is a diagram showing one example of a settling time-period setting table in the quadrupole mass spectrometer according to the embodiment.
FIG. 7 is a graph showing one example of an SIM/scan alternate measurement sequence in the quadrupole mass spectrometer according to the embodiment, wherein a response speed of a voltage U is less than that of a voltage V.

The optimal settling-time calculation sub-section 101 prestores therein a settling-time setting table as shown in FIG. 6. The settling-time setting table is designed to output an optimal settling time using an after-mentioned mass-value difference ΔM and an after-mentioned post-change mass value as an input. Specifically, under a condition that the post-change mass value is constant, the settling time-period becomes shorter as the mass-value difference ΔM becomes smaller. Further, under a condition that the mass-value difference ΔM is constant, the settling time-period becomes shorter as the post-change mass value becomes larger. In this example, when the mass-value difference ΔM is in the range of zero to 99, and the post-change mass value is in the range of 100 to 1090, the settling time-period is set to a shortest value of 1 ms. Differently, when the mass-value difference ΔM is equal to or greater than 300, and the post-change mass value is in the range of 2 to 49, the settling time-period is set to a longest value of 5 ms.

Under the condition that the post-change mass value is constant, when the mass-value difference ΔM is relatively small, a change in each of the input voltages U, V to the rod electrodes 3*a* to 3*d* is also relatively small. Consequently, a level of undershoot (overshoot) and ringing is also relatively low, and therefore the input voltage will become stable within a relatively short period of time. This is a reason why the settling time-period is controlled to become shorter as the mass-value difference ΔM becomes smaller under the condition that the post-change mass value is constant. Further, under the condition that the mass-value difference ΔM is constant, when the post-change mass value is relatively large, each of the input voltages U, V to the rod electrodes is also relatively high. Consequently, even if undershoot (overshoot) and ringing occur at the same level when the input voltage is rapidly changed from a certain value, an influence thereof becomes relatively smaller. In addition, sensitivity of an ion to a voltage varies depending on a mass of the ion. Specifically, an ion having a larger mass is less affected by fluctuation in voltage. Therefore, under the condition that the mass-value difference ΔM is constant, the settling time-period can be set to become shorter as the post-change mass value becomes larger.

In response to designation of the above analysis conditions (parameters), in the control section 10, the optimal settling-time calculation sub-section 101 is operable to calculate a mass-value difference, i.e., a difference between a first one of the designated mass values, and a second one of the remaining mass values which is used for a measurement to be performed just before a measurement for the first mass value, and then cross-check the calculated mass-value difference ΔM and each of the mass values (as a next-measurement mass value) with the settling time-period setting table to derive a settling time-period corresponding to them, from the settling time-period setting table. In a state after the five mass values are rearranged in descending order of mass value (see FIG. 2) in the above manner, a settling time-period Tset4 just before a measurement for the mass value M14 is determined based on the mass value M14 and a mass-value difference ΔM=M15−M14, and a settling time-period Tset3 just before a measurement for the mass value M13 is determined based on the mass value M13 and a mass-value difference ΔM=M14−M13. Further, a settling time-period Tset2 just before a measurement for the mass value M12 is determined based on the mass value M12 and a mass-value difference ΔM=M13−M12, and a settling time-period Tset1 just before a measurement for the mass value M11 is determined based on the mass value M11 and a mass-value difference ΔM=M12−M11. A settling time-period Tset5 just before a measurement for the mass value M15 is determined based on the mass value M15 and a mass-value difference ΔM=M15−M11. Thus, the settling time-period is set to a longer value as the mass-value difference ΔM becomes larger. Further, the settling time-period is set to a longer value as the next-measurement mass value becomes smaller.

Then, the measurement sequence pattern determination sub-section 102 is operable to calculate a preliminary measurement time-period Tdw' for each of the mass values, based on the interval span Ta, the settling time-periods Tset1 to Tset5, and the number n of the mass values (in this example, five), according to the following formula:

$$Tdw'[\mathrm{ms}]=\{Ta-(T\mathrm{set}1+T\mathrm{set}2+T\mathrm{set}3+T\mathrm{set}4+T\mathrm{set}5)\}/n$$

Figure 2:
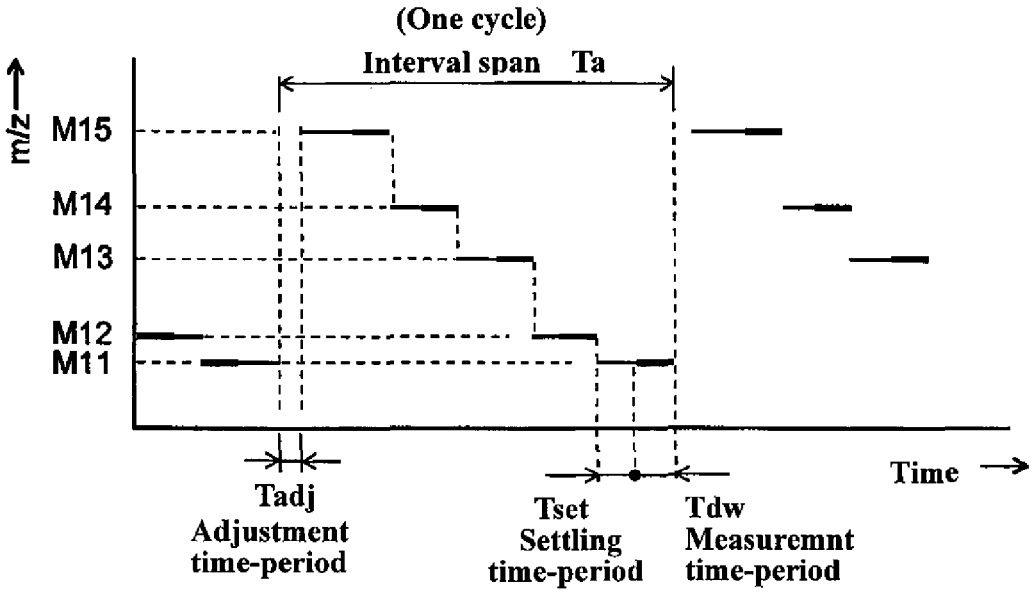
FIG. 2 is a graph showing one example of an SIM measurement sequence in the quadrupole mass spectrometer according to the embodiment, wherein a response speed of a voltage U is less than that of a voltage V.

Then, the measurement sequence pattern determination sub-section 102 is operable to integerize the preliminary measurement time-period Tdw' to set an obtained integer value as a final measurement time-period Tdw and set a remainder resulting from the integerization, as an inter-interval adjustment time-period Tadj. Through the above operation, a control sequence for repeating the SIM measurement as shown in FIG. 2 is determined. Further, the input voltages U, V are automatically derived according to the mass values, and therefore a voltage control pattern for the SIM measurement is determined.

Subsequently, when the user issues the instruction on start of the SIM measurement, the control section 10 is operable to control the ion-selecting voltage generation section 13 according to the determined voltage control pattern to appropriately change a voltage (specifically, the DC voltage U and an amplitude of the RF voltage V) to be applied to the rod electrodes 3*a* to 3*d* of the quadrupole mass filter 3. As a result, as shown in FIG. 2, when the mass-value difference before and after the change between the mass values is relatively larger, the settling time-period becomes relatively short, as compared to when the mass-value difference is relatively small. Further, when the post-change mass value is relatively larger, the settling time-period becomes relatively short, as compared to when the post-change mass value is relatively small. In this example, the interval span Ta is fixed, and thereby the measurement time-period Tdw becomes longer as the settling time-period becomes shorter. Therefore, an ion detection time-period for each of the mass values becomes longer, so that sensitivity and SN ratio are enhanced.

Differently, in case where a user sets only the measurement time-period Tdw as an analysis condition without designating or fixing the interval span Ta, the interval span Ta becomes shorter as the settling time-period becomes shorter. This means that the number of repetitions of the interval span Ta per second is increased, or a time interval between adjacent measurements for one (e.g., M11) of the mass values is shortened. Thus, time resolution is enhanced. This makes it possible to accurately analyze a target component contained in a sample gas introduced from the GC into the quadrupole mass spectrometer without missing a peak of the target component on a chromatogram even in a situation where an appearance time of the target component is short, i.e., the peak of the target component is sharp.

Figure 3:
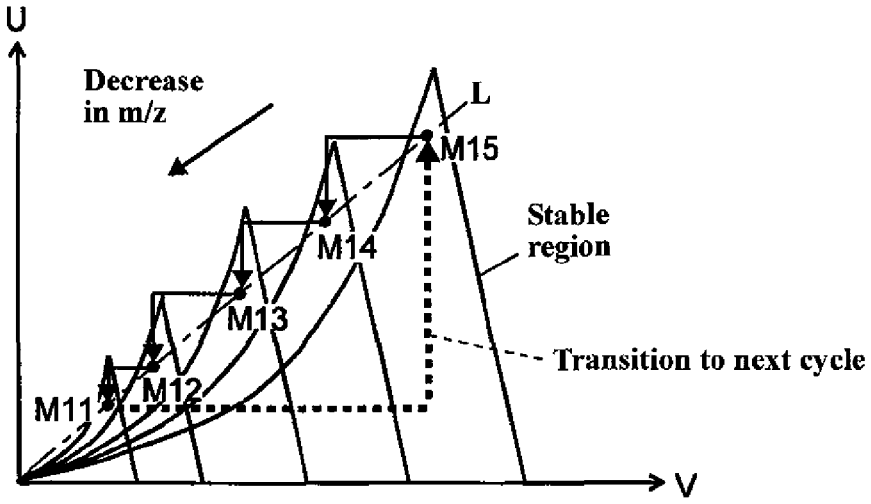
FIG. 3 is a stability diagram showing respective changes of the voltages U, V in FIG. 2.

Under a condition that the input voltage U has a response speed less than that of the input voltage V, the mass values for the SIM measurement can be arranged in descending order of mass value in the above manner to keep unwanted ions from passing through the quadrupole mass filter 3 during a course of changing between the mass values. This advantageous effect will be explained using a stability diagram (so-called Mathieu stability diagram) based on a stability condition as a solution of the Mathieu equation. A stable region where an ion can exist stably (i.e., without divergence) in a quadrupolar electrical field is a generally triangular region as shown in FIG. 3. In the SIM measurement, when the mass value is changed in the sequence of M15→M14→ - - - , the stable region moves as shown in FIG. 3. Thus, the mass value for an ion to be allowed to pass through the quadrupole mass filter 3 can be linearly changed in the above manner by changing the voltages U, V as indicated by the one-dot chain line L in FIG. 3.

However, the change along the straight line L is obtained only if a voltage ratio U/V is maintained at constant value. If a change of the voltage U has a delay relative to that of the voltage V, the voltage ratio U/V is changed in a downward staircase pattern as indicated by the arrowed line in FIG. 4, when illustrated in an exaggerated form. In other words, a locus of the change in the voltage ratio U/V is formed above the straight line L. During the course of changing between the mass values, the U/V line is located on the locus, and most of the U/V line is located outside the stable region. Therefore, during the course of changing between the mass values, ions introduced into the quadrupole mass filter 3 is highly likely to become unstable and diverge on the way due to collision with the rod electrodes or jumping out of the rod electrodes. This makes it possible to reduce the number of ions undesirably passing through the quadrupole mass filter 3 and reaching the ion detector 4 during the course of changing between the mass values. Under the condition that the input voltage U has a response speed less than that of the input voltage V, if the SIM measurement is performed in reverse order, i.e., in ascending order of mass value, the locus of the change in the voltage ratio U/V is located below the straight line L, and thereby becomes highly likely to pass through the stable region. Thus, unwanted ions become highly likely to pass through the quadrupole mass filter 3 to cause a risk that an excessive amount of ions enter the ion detector 4.

As seen in FIG. 3, during the operation of sequentially changing between the mass values in one cycle, the locus of the change in the voltage ratio U/V is likely to pass through a region outside of the stable region. However, during a transitional period between completion of the last measurement for the mass value M11 in a certain cycle and start of the first measurement for the mass value M15 in a next cycle, a locus of the change in the voltage ratio U/V becomes highly likely to pass through a region outside of the stable region. In this case, the mass-value difference is relatively large, so that the locus of the change in the voltage ratio U/V during the transition is increased in length when viewed in FIG. 3. However, an actual time required for the transition is not so largely dependent on the mass-value difference. Thus, an amount of ions to be allowed to pass through the quadrupole mass filter 3 during the transitional period for changing the mass value from M11 to M15 is approximately equal to an amount of ions to be allowed to pass through the quadrupole mass filter 3 in a hypothetical case where a locus of the change in the voltage ratio U/V passes through the stable region during a course of changing the mass value, for example, from M15 to M14. For this reason, when the change of the voltage U has a delay relative to that of the voltage V, the technique of arranging the mass values in descending order of mass value to perform the SIM measurement in this order can more effectively reduce an amount of unwanted ions reaching the ion detector 4.

Although an influence of ions undesirably passing through the quadrupole mass filter 3 during the traditional period for changing from the smallest one to the largest one of the designated mass values is actually not so large as described above, a voltage control may be added to block such ions from passing through the quadrupole mass filter 3. Specifically, the control section may be configured to control the ion-optical-system voltage generation section 21 in such a manner that an input voltage to the ion transport optical system 2 is set to be a given DC voltage having a polarity opposite to that of the ions during only a given part of a time-period after completion of a measurement for the mass value M11 through until each of the voltages U, V is returned to a value corresponding to the mass value M15. Based on this control, an electric field is formed by the ion transport optical system 2, and ions attracted by the electric field are deviated from a normal path, just before entering the quadrupole mass filter 3, so that the ions are kept from entering the quadrupole mass filter 3. This makes it possible to block the ions from passing through the quadrupole mass filter 3.

Alternatively, when the quadrupole mass filter 3 comprises a main filter, and a pre-filter disposed upstream of the main filter, a DC voltage having a polarity opposite to ions may be temporarily applied to the pre-filter to block the ions from entering the main filter.

Figure 4:
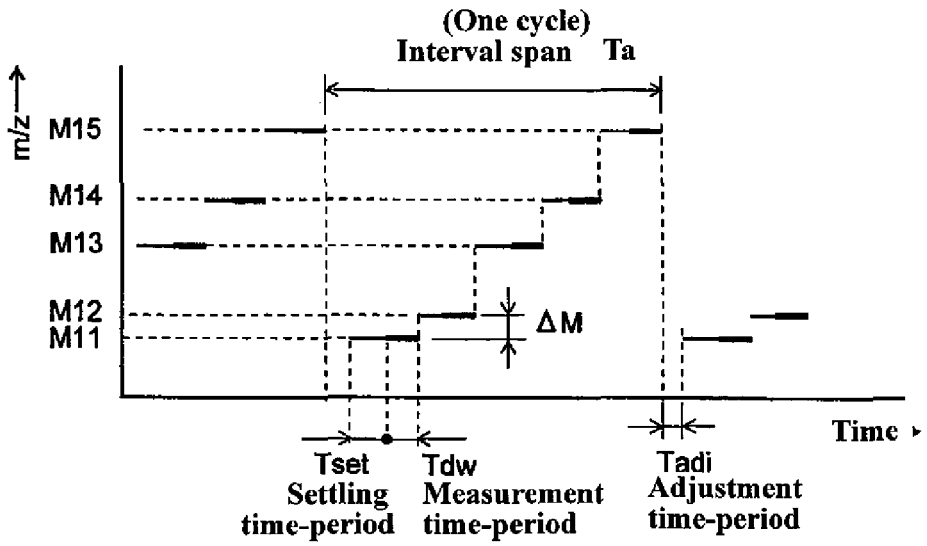
FIG. 4 is a graph showing another example of the SIM measurement sequence in the quadrupole mass spectrometer according to the embodiment, wherein the response speed of the voltage V is less than that of the voltage U.
Figure 5:
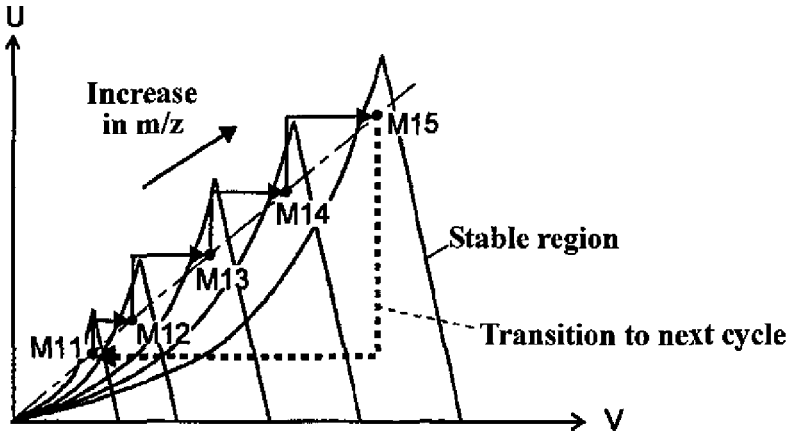
FIG. 5 is a stability diagram showing respective changes of the voltages U, V in FIG. 4.

The above description has been made on the assumption that a response speed in terms of voltage change based on the DC voltage generation sub-section 16 is less than a response speed in terms of amplitude change based on the RF voltage generation sub-section 15, i.e., in the ion-selecting voltage $\pm(U+V\cdot\cos\omega t)$, the voltage U has a response speed less than that of the voltage V. Conversely, in case where a response speed in terms of amplitude change based on the RF voltage generation sub-section 15 is less than a response speed in terms of voltage change based on the DC voltage generation sub-section 16, i.e., in the ion-selecting voltage $\pm(U+V\cdot\cos\omega t)$, the voltage V has a response speed less than that of the voltage U, operations and controls become opposite to those in the above description. In this case, as shown in FIGS. 4 and 5 corresponding to FIGS. 2 and 3, a plurality of designated mass values may be rearranged in ascending order of mass value to obtain the same advantageous effects of shortening a settling time-period and keeping unwanted ions from entering the ion detector 4.

The following description will be made about another case where the quadrupole mass spectrometer performs an SIM/scan alternate measurement mode which is configured to alternately perform a SIM measurement for a plurality of designated mass values and a scan measurement over a designated mass range. An operation under a condition that a response speed in terms of voltage change based on the DC voltage generation sub-section 16 is less than a response speed in terms of amplitude change based on the RF voltage generation sub-section 15, will be firstly described.

In the SIM/scan alternate measurement mode, in advance to issuing an instruction on start of the SIM/scan alternate measurement, a person responsible for analysis or operator uses the input section 11 to input and designate, as analysis conditions, a plurality of mass values for the SIM measurement, lower-limit and upper-limit mass values for the scan measurement, an interval span Ta which is a total duration of the SIM/scan measurement (one cycle), and an interval span Tb which is a duration of only the scan measurement. In this example, five mass values M11, M12, M13, M14, M15 (wherein M11<M12<M13<M14<M15) are designated as the mass values for the SIM measurement, and the mass range for the scan measurement is set between Ms and Me.

The control section 10 is operable to define the lower-limit mass value and the upper-limit mass value for the scan measurement, respectively, as a scan-start mass value and a scan-end mass value, so as to set a continuous change in mass value in an ascending direction over the designated mass range. Further, the control section 10 is operable to rearrange the mass values designated for the SIM measurement in descending order of mass value. This operation is the same as that in the above the SIM measurement mode as a single mode.

Then, the optimal settling-time calculation sub-section 101 is operable to subtract the interval span Tb as a duration of only the scan measurement, from the interval span Ta as a total duration of the SIM/scan measurement, to obtain an interval span assigned to the SIM measurement, and obtain a settling time-period for each of the mass values, based on a mass-value difference between a pre-change mass value and a post-change mass value, and the post-change mass value. A technique of obtaining the settling time-period is as described above. After the settling time-periods are determined, the measurement-sequence determination sub-section 102 is operable to calculate a measurement time-period Tda each of the mass values, based on the interval span assigned to the SIM measurement, each of the settling time-periods, and a total number of the mass values. Then, the measurement-sequence determination sub-section 102 is finally operable to determine one cycle of the SIM/scan alternate measurement sequence as shown in FIG. 7. According to the SIM/scan alternate measurement sequence, the control section 10 is operable to control the ion-selecting voltage generation section 13 to apply a voltage to the rod electrodes 3*a* to 3*d* of the quadrupole mass filter 3.

In the SIM/scan alternate measurement, the quadrupole mass spectrometer can also shorten the settling time-period for each of the mass values for the SIM measurement, and keep unwanted ions from entering the ion detector 4 during change between the mass values. Furthermore, during transition from the last one of the mass values for the SIM measurement to the scan-start mass value for the scan measurement, and during transition from the scan-end mass value for the scan measurement to the first one of the mass values for the SIM measurement, a mass-value difference becomes relatively small. In this regard, the settling time-period can further be shortened.

Figure 8:
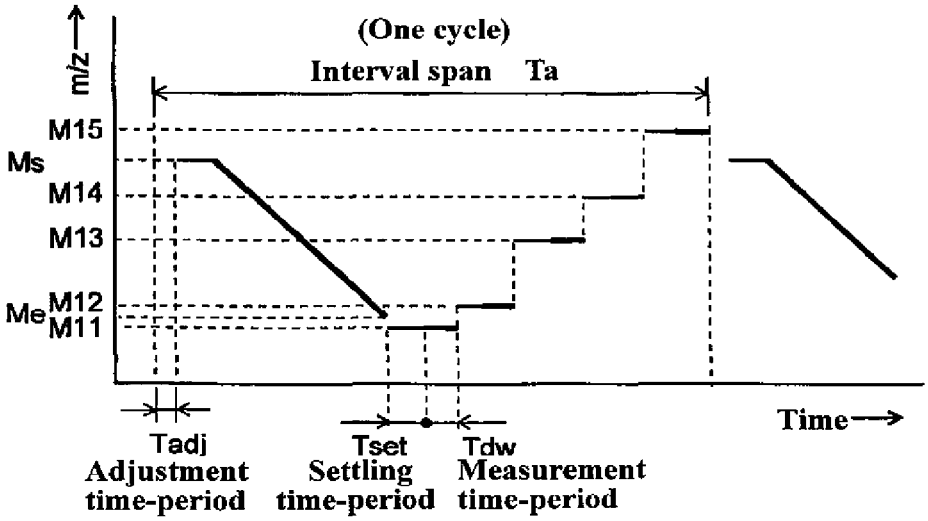
FIG. 8 is a graph showing another example of the SIM/scan alternate measurement sequence in the quadrupole mass spectrometer according to the embodiment, wherein the response speed of the voltage V is less than that of the voltage U.
Figure 9A:
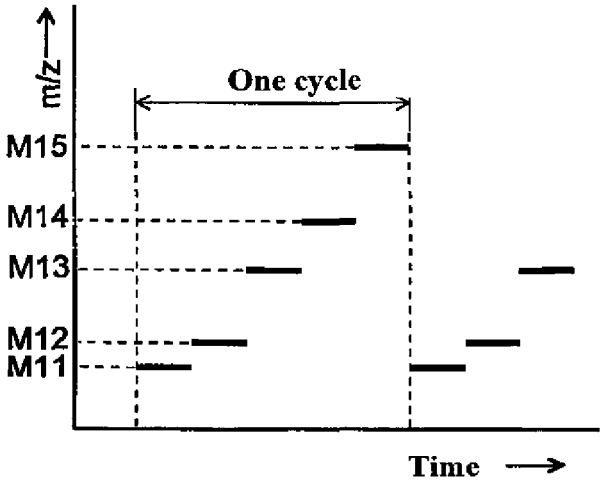
FIG. 9A Prior Art
FIGS. 9A and 9B are graphs showing examples of an SIM measurement sequence.
Figure 9B:
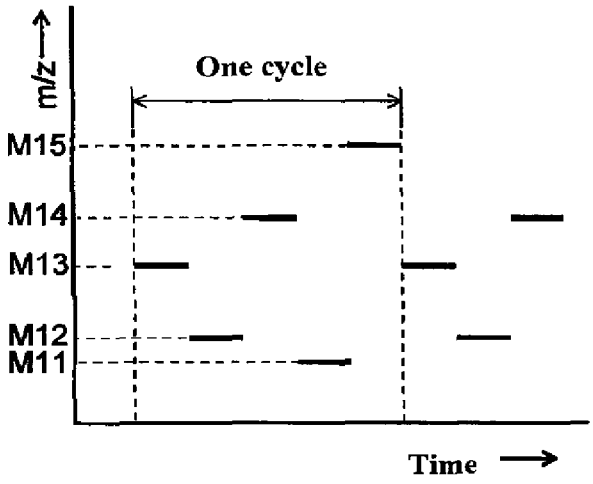
FIG. 9B Prior Art

An operation under a condition that a response speed in terms of amplitude change based on the RF voltage generation sub-section 15 is less than a response speed in terms of voltage change based on the DC voltage generation sub-section 16, will be secondly described. In this case, in response to an analysis condition set in the above manner in advance of issuing an instruction on start of the SIM/scan alternate measurement, the control section 10 is operable to define the upper-limit mass value and the lower-limit mass value for the scan measurement, respectively, as a scan-start mass value and a scan-end mass value, so as to set a continuous change in mass value in a descending direction over the designated mass range. Further, the control section 10 is operable to rearrange the mass values designated for the SIM measurement in ascending order of mass value. Then, a settling time-period for each of the mass values is calculated, and a measurement sequence as shown in FIG. 8 is determined. An obtainable effect is as described above.

Generally, superiority between a response speed in terms of voltage change based on the DC voltage generation sub-section 16 and a response speed in terms of amplitude change based on the RF voltage generation sub-section 15 is dependent on a configuration of a quadrupole mass spectrometer. Thus, typically, in a stage of design or manufacturing of the quadrupole mass spectrometer, it is automatically determined which of the measurement sequences in FIGS. 2 and 4 is adequate for the SIM measurement mode, and which of the measurement sequences in FIGS. 7 and 8 is adequate in the SIM/scan alternate measurement mode.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A quadrupole mass spectrometer equipped with a quadrupole mass filter for allowing an ion having a specific mass to selectively pass therethrough and a detector for detecting the ion passing through the quadrupole mass filter, and designed to perform a selected ion monitoring (SIM) or multiple reaction monitoring (MRM) measurement configured to repeat a cycle of operation to sequentially change between a plurality of pre-set mass values for respective ions to by allowed to pass through the quadrupole mass filter, the quadrupole mass spectrometer comprising:

a quadrupole driving unit comprising:

a first voltage-variable DC voltage source; and an amplitude-variable AC voltage source, wherein the quadrupole driving unit configured to apply a combined voltage formed by adding a first DC voltage from the first DC voltage source and an AC voltage from the AC voltage source, to the quadrupole mass filter having four electrodes;

a measurement sequence creation unit which rearranges a plurality of mass values designated for performing the SIM or MRM measurement, in a descending order of mass value, to create one cycle of an SIM or MRM measurement sequence, wherein the quadrupole driving unit is configured such that a voltage change response speed of the first DC voltage source is less than an amplitude change response speed of the AC voltage source;

a pre-filter or an optical system disposed upstream of the quadrupole mass filter which introduces an ion into the quadrupole mass filter; and an input voltage control unit which applies a second DC voltage having a polarity opposite to that of a target ion, to the pre-filter or the ion optical system, in such a manner as to block the target ion from passing therethrough, during at least a part of a time-period between a completion of a first cycle of the SIM or MRM measurement and a start of a second cycle of the SIM or MRM measurement.

2. A quadrupole mass spectrometer equipped with a quadrupole mass filter for allowing an ion having a specific mass to selectively pass therethrough and a detector for detecting the ion passing through the quadrupole mass filter, and designed to perform a selected ion monitoring (SIM) or multiple reaction monitoring (MRM) measurement configured to repeat a cycle of operation to sequentially change between a plurality of pre-set mass values for respective ions to be allowed to pass through the quadruple mass filter, the quadrupole mass spectrometer comprising:

a quadrupole driving unit comprising:

a first voltage-variable DC voltage source; and an amplitude-variable AC voltage source, wherein the quadrupole driving unit configured to apply a combined voltage formed by adding a DC voltage from the DC voltage source and an AC voltage from the AC voltage source to the quadrupole mass filter having four electrodes;

a measurement sequence creation unit which rearranges a plurality of mass values designated for performing the SIM or MRM measurement, in an ascending order of mass value, to create one cycle of an SIM or MRM measurement sequence, wherein the quadrupole driving unit is configured such that a voltage change response speed of the first DC voltage source is greater than an amplitude change response speed of the AC voltage source;

a pre-filter or an ion optical system disposed upstream of the quadruple mass filter which introduces an ion into the quadrupole mass filter; and an input voltage control unit which applies a second DC voltage having a polarity opposite to that of a target ion, to the pre-filter or the ion optical system, in such a manner as to block the target ion from passing therethrough, during at least a part of a time-period between a completion of a first cycle of the SIM or MRM measurement and a start of a second cycle of the SIM or MRM measurement.

3. The quadrupole mass spectrometer as defined in claim 1, wherein the quadrupole driving unit maintains a voltage ratio between the first DC voltage and the AC voltage at a constant value.

4. The quadrupole mass spectrometer as defined in claim 2, wherein the quadrupole driving unit maintains a voltage ratio between the first DC voltage and the AC voltage at a constant value.

5. The quadrupole mass spectrometer as defined in claim 1, wherein the voltage change response speed comprises a DC time period required for the first DC voltage of the first DC voltage source to stabilize and the amplitude change response speed comprises an AC time period required for the AC voltage of the AC voltage source to stabilize.

6. The quadrupole mass spectrometer as defined in claim 2, wherein the voltage change response speed comprises a DC time period required for the first DC voltage of the first DC voltage source to stabilize and the amplitude change response speed comprises an AC time period required for the AC voltage of the AC voltage source to stabilize.

7. A quadrupole mass spectrometer having a quadrupole mass filter which allows an ion with a specific mass to selectively pass through the quadrupole mass filter and a detector which detects the passed-through ion, which performs a selected ion monitoring (SIM) or multiple reaction monitoring (MRM) measurement configured to repeat a cycle of operation to sequentially change between a plurality of preset mass values for respective ions to be allowed to pass through the quadrupole mass filter, the quadrupole mass spectrometer comprising:

quadrupole driving unit comprising:

a first voltage-variable DC voltage source which supplies a first DC voltage;

an amplitude-variable AC voltage source which supplies an AC voltage; and an adder unit which adds the DC voltage and the AC voltage, wherein the quadrupole driving unit applies the added DC voltage and the AC voltage to the quadrupole mass filter;

a measurement sequence creation unit which rearranges a plurality of mass values in an order of a sequence in a cycle of the SIM or MRM measurement, wherein measurement sequence creation unit is configured such that, if the quadrupole driving unit is configured such that a voltage change response speed of the first DC voltage source is less than an amplitude change response speed of the AC voltage source, the measurement sequence creation unit rearranges the plurality of mass values in a descending order, and the measurement sequence creation unit is configured such that, if the quadrupole driving unit is configured such that the voltage change response sped of the first DC voltage source is greater than the amplitude change response speed of the AC voltage source, the measurement sequence creation unit rearranges the plurality of mass value in an ascending order;

a pre-filter or ion optical system disposed upstream of the quadrupole mass filter; and an input voltage control unit which applies a second DC voltage having a polarity opposite to that of a target ion to the pre-filter or the ion optical system between a completion of a first cycle of the SIM or MRM measurement and a start of a second cycle of the SIM or MRM measurement.

8. The quadrupole mass spectrometer as defined in claim 7, wherein the quadrupole driving unit maintains a voltage ratio between the first DC voltage and the AC voltage at a constant value.

9. The quadrupole mass spectrometer as defined in claim 7, wherein the voltage change response speed comprises a DC time period required for the first DC voltage of the first DC voltage source to stabilize and the amplitude change response speed comprises an AC time period required for the AC voltage of the AC voltage source to stabilize.

10. A method of performing a selected ion monitoring (SIM) or multiple reaction monitoring (MRM) measurement using a quadrupole mass spectrometer having a quadrupole mass filter which allows an ion with a specific mass to selectively pass through the quadrupole mass filter and a detector which detects the passed-thorough ion, the method comprising:

supplying a first DC voltage by a first voltage-variable DC voltage source;

supplying an AC voltage by an amplitude-variable AC voltage source;

adding the DC voltage and the AC voltage by an adding unit;

applying the added DC voltage and the AC voltage to the quadrupole mass filter;

providing a plurality of mass values as an input;

rearranging the plurality of mass values in an order of a sequence in a cycle of the SIM or MRM measurement; and applying a second DC voltage having a polarity opposite to that of a target ion to the pre-filter or the ion optical system between a completion of a first cycle of the SIM or MRM measurement and a start of a second cycle of the SIM or MRM measurement, wherein if a voltage change response speed of the first DC voltage source is less than an amplitude change response speed of the AC voltage source, rearranging the plurality of mass values in a descending order, and if the voltage change response speed of the first DC voltage source is greater than the amplitude change response speed of the AC voltage source, rearranging the plurality of mass values in an ascending order.

11. The method as defined in claim 10 further comprises maintaining a voltage ratio between the first DC voltage and the AC voltage at a constant value.

12. The method as defined in claim 10, wherein the voltage change response speed comprises a DC time period required for the first DC voltage of the first DC voltage source to stabilize and the amplitude change response speed comprises an AC time period required for the AC voltage of the AC voltage source to stabilize.

* * * * *